United States Patent [19]

Place, Jr.

[11] 4,076,407

[45] Feb. 28, 1978

[54] DUPLEX COPYING TRANSFER SYSTEM

[75] Inventor: George H. Place, Jr., Webster, N.Y.

[73] Assignee: Xerox Corporation, Stamford, Conn.

[21] Appl. No.: 668,008

[22] Filed: Mar. 18, 1976

[51] Int. Cl.[2] ..... G03G 15/00; G03G 15/16

[52] U.S. Cl. ..... 355/14; 355/3 TR; 355/23

[58] Field of Search ..... 355/14, 3 R, 3 TR, 3 CH, 355/23-26; 250/324-326; 317/262 A; 96/1.4, 1 TE; 271/DIG. 2

[56] References Cited

U.S. PATENT DOCUMENTS

| | | | |
|---|---|---|---|
| 3,506,259 | 4/1970 | Caldwell et al. | 355/3 R |
| 3,554,161 | 1/1971 | Blanchette | 250/325 |
| 3,615,129 | 10/1971 | Drawe et al. | 355/3 R |
| 3,729,311 | 4/1973 | Langdon | 355/14 |
| 3,970,381 | 7/1976 | Meagher et al. | 355/3 R |

*Primary Examiner*—Donald A. Griffin
*Assistant Examiner*—W. J. Brady

[57] ABSTRACT

In an electrostatographic duplex copying system wherein a first image is transferable from an image support surface to one side of a copy sheet by electrical transfer fields, and the copy is then removed from the image support surface, and the first image thermally fused, and the copy sheets are then subsequently returned to the image support surface for the transfer of a different image to the other side of the sheets, duplex switching means are provided for changing the level of the net applied transfer fields for the second side transfer to compensate for changes in the characteristics of the copy sheet from the first side transfer and fusing, preferably by switching the D.C. bias level of a D.C. biased A.C. transfer detacking corona generator.

1 Claim, 2 Drawing Figures

DUPLEX COPYING TRANSFER SYSTEM

Figure 1:
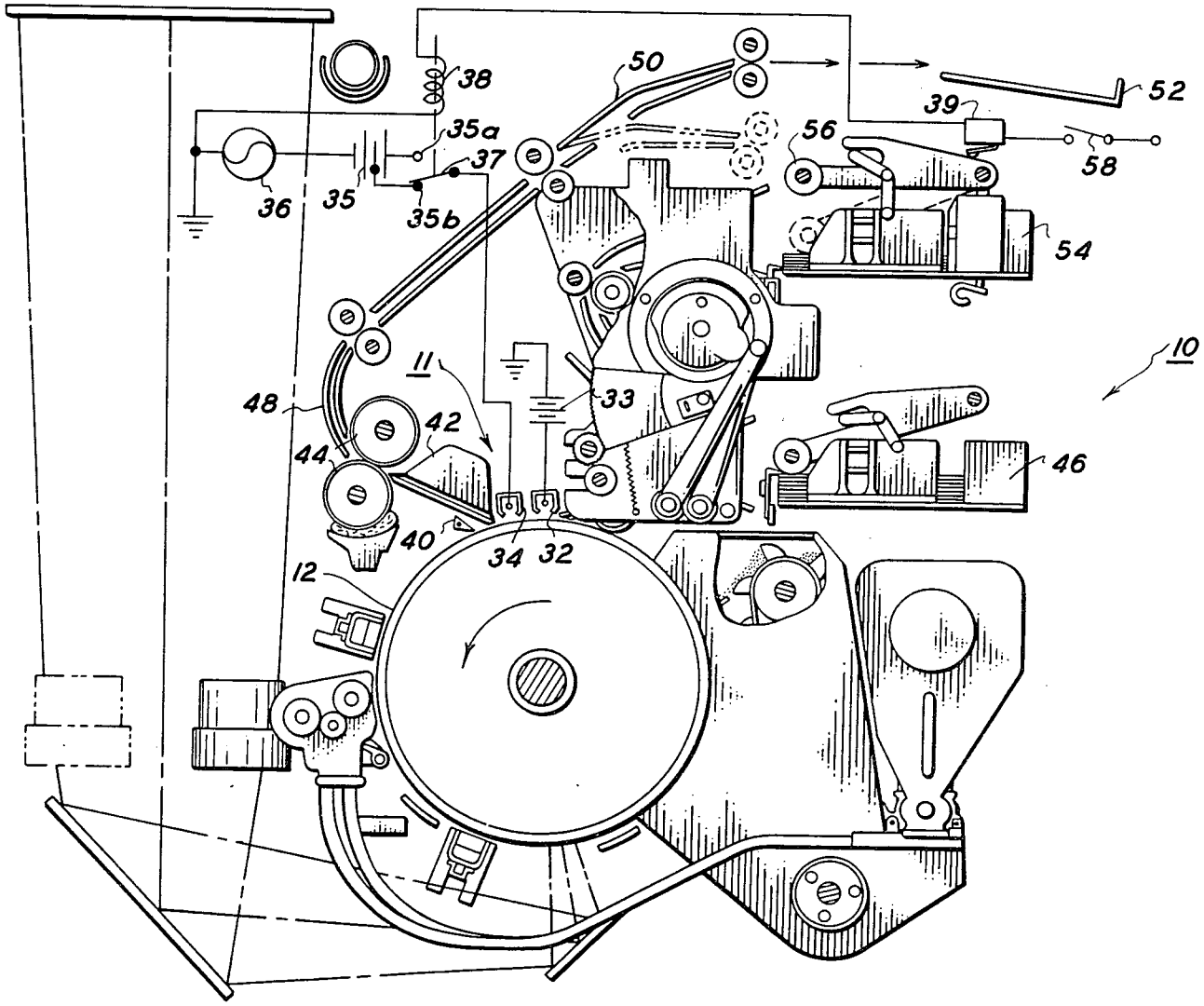

The present invention relates to an image transfer system in electrostatography and particularly to the transfer of an image to the second side of a copy sheet with different electrical characteristics.

In a conventional transfer station in electrostatography, toner (image developer material) is transferred from the photoreceptor (the original support and imaging surface) to one side of the copy sheet (the final support surface or transfer member). The copy sheet is then stripped from the original image support surface with the toner image thereon, and the toner is then fixed to the copy sheet, typically in a subsequent thermal fusing station.

In xerography, this toner image transfer is most commonly achieved by electrostatic force fields created by D.C. charges applied to or adjacent the back of the copy sheet while the front side of the copy sheet contacts the toner-bearing photoreceptor surface. The transfer field must be sufficient to overcome the forces holding the toner onto the photoreceptor and to attract the toner over onto the overlying copy sheet. These transfer fields are generally provided in one of two ways: by D.C. corona current emission from a transfer corona generator of charges opposite in polarity to the toner, onto the copy paper; or by an electrically biased transfer roller or belt rolling along the back of the copy sheet and holding it against the photoreceptor. However, the transfer fields are preferably substantially reduced or neutralized prior to and/or during the stripping of the copy sheet from the photoreceptor to prevent disturbances to the unfused toner image. Preferably this is done by setting a D.C. bias on an A.C. detacking corona generator to provide an appropriate nominal unbalanced A.C. current output. This is taught by U.S. Pat. Nos. 3,870,515, issued Mar. 11, 1975, to N. H. Kaupp and 3,357,400, issued Dec. 12, 1967, to A. T. Manghirmalani.

It is well known in the art to adjust a transfer voltage level in order to maximize transfer efficiency under changed transfer conditions, such as humidity changes. Also, it is known to adjust the transfer level between image transfers, in order to make multiple transfers of imaging material to different copy sheets from the same latent image in sequence, as in U.S. Pat. Nos. 3,413,063, to C. J. Young, issued Nov. 26, 1968, and R. G. Olden, 3,363,555, issued Jan. 16, 1968, or to make successive superimposed transfers of different imaging color material from different latent images to the same side of a copy sheet by providing an increase in the transfer potential for each successive image transfer, e.g., U.S. Pat. Nos. 3,620,616, issued Nov. 16, 1971, to J. R. Davidson et al., and 3,729,311, issued Apr. 24, 1973, to M. J. Langdon, or a decrease, as in U.S. application Ser. No. 421,387, filed in 1973, by R. F. Lehman.

Some other examples of transfer charge level control or switching systems are described in U.S. Pat. Nos. 2,951,443, issued Sept. 6, 1960, to J. F. Byrne; 3,244,083, issued Apr. 5, 1966, to R. W. Gundlach; 3,860,436, issued Jan. 14, 1975, to T. Meagher; 3,837,741, issued Sept. 24, 1974, to P. R. Spencer; 3,805,069, issued Apr. 16, 1974, to D. H. Fisher; and 3,877,416, issued Apr. 15, 1975, to J. M. Donohue et al., the latter three teaching transfer level control with humidity changes.

U.S. Pat. No. 3,506,259, issued Apr. 14, 1970 to J. P. Caldwell at Col. 6, lines 32–41, suggests pulsing a detacking corotron to act only upon the leading portion of the [image] support material while completing the stripping by having the vacuum transport pull the remaining portion of the support away from the drum. However, a continuously operating detacking corotron is stated to be preferred, and controll by varying the applied voltage by impressing an A.C. voltage on an adaptable D.C. bias is taught (Col. 5, lines 15–19).

U.S. Pat. No. 3,304,476, issued Feb. 14, 1967, to J. J. Schoen et al., teaches switching the polarity of the D.C. potential applied to a corona generator to allow the same corona generator to be used for both transfer and for plate neutralizing for cleaning after transfer.

The difficulties of successful electrostatographic image transfer and copy sheet stripping are well known. In the pre-transfer (pre-nip) region or area, before the copy paper contacts the image, if the transfer fields are high the toner image is susceptible to premature transfer across too great an air gap, leading to decreased image resolution and, in general, to fuzzy images. Further, if there is pre-nip ionization, it may lead to strobing defects, loss of transfer efficiency, or "splotchy" transfer and a lower latitude of acceptable system operation. In the post-nip region, at the photoconductor-paper separation or stripping area, if the transfer fields are too low hollow characters may be generated, especially with smooth papers, high toner pile heights and high nip pressures. On the other hand if the fields are too high in certain portions of the post-nip region then the resulting ionization may cause image instability, particularly if the charged copy sheet contacts a conductive surface. High post-nip fields can cause lead edge stripping problems for the copy sheet. In the nip region itself, to achieve high transfer efficiency and avoid retransfer, the transfer field level should, in general, be as high as possible. To achieve these desired electrical conditions in these adjacent regions consistently with appropriate transitions is difficult. For example, it is well known in the art that serious transfer problems, particularly in high humidity environments, can be caused by conduction by the copy paper of the applied transfer potential, i.e., by changes in the resistivity of the copy sheet. E.g., early U.S. Pat. No. 2,847,305, issued Aug. 12, 1958, to L. E. Walkup. Further, it is known that the direction and extent of the lead edge curl of the copy sheet can significantly affect the detacking neutralization and stripping operation. It has been observed that the image fusing process can substantially affect both copy sheet humidity and, therefore, resistivity and also change or impart lead edge curl, with either radiant or roll (contact) fusers.

It is known to change a corona generator output in response to a change in the resistivity of the surface being charged, e.g., U.S. Pat. No. 3,554,161, to R. G. Blanchette. This U.S. Pat. No. 3,554,161 discloses a ground path for the shield of a developer corona generator, which ground path is conducted through part of the photoelectric recording member itself so as to change the voltage level of the shield in response to resistance changes in that recording member and, therefore, to change the corona output.

It is well known to provide manual or semi-automatic duplex copying in which finished simplexed copy sheets are removed from an output tray and reinserted in an input sheet feeding tray for (second-pass) printing of another image on the opposite side. Further, fully automatic xerographic duplexing copiers are known in which images are first transferred to one side of a copy sheet, then fused and held in an intermediate (duplex) tray, and then fed back (inverted) to the same transfer station for transfer of another image to the opposite side of the sheet, for example, the Xerox "4000" copier. U.S. Pat. Nos. 3,615,129, issued Oct. 26, 1971, to W. A. Drawe et al., and 3,645,615, issued Feb. 29, 1972, to M. R. Spear, Jr., are noted.

The present invention relates to sequential or dual-pass duplexing systems, as distinguished from single-pass or simultaneous duplex in which unfused images are transferred from two different image support surfaces to opposite sides of the copy sheet. Examples of single-pass duplex systems are disclosed in U.S. Pat. Nos. 3,697,171, issued Oct. 10, 1972, to W. A. Sullivan; 3,847,478, issued Nov. 12, 1974, to E. F. Young, and the art cited therein. In such systems, where there is an initial transfer of a one image to an intermediate surface, such as an opposing roller, the transfer level potential for that initial transfer is changed from that for the image retransfer to the copy sheet and the transfer of the other image to the other side of the sheet, e.g., Col. 6, of U.S. Pat. No. 3,697,171.

The transfer system of the invention is intended to overcome or reduce many of these transfer problems with a simple and inexpensive transfer structure. It may be utilized for electrostatic transfer from an imaging surface of any desired configuration or construction, e.g., either a cylinder or a belt.

The references cited herein teach details of various suitable exemplary xerographic or other electrostatographic structures, materials, systems and functions known to those skilled in the art, and are incorporated by reference to this specification, where appropriate. Accordingly, the following description is confined to the novel aspects of the present invention.

Figure 2:
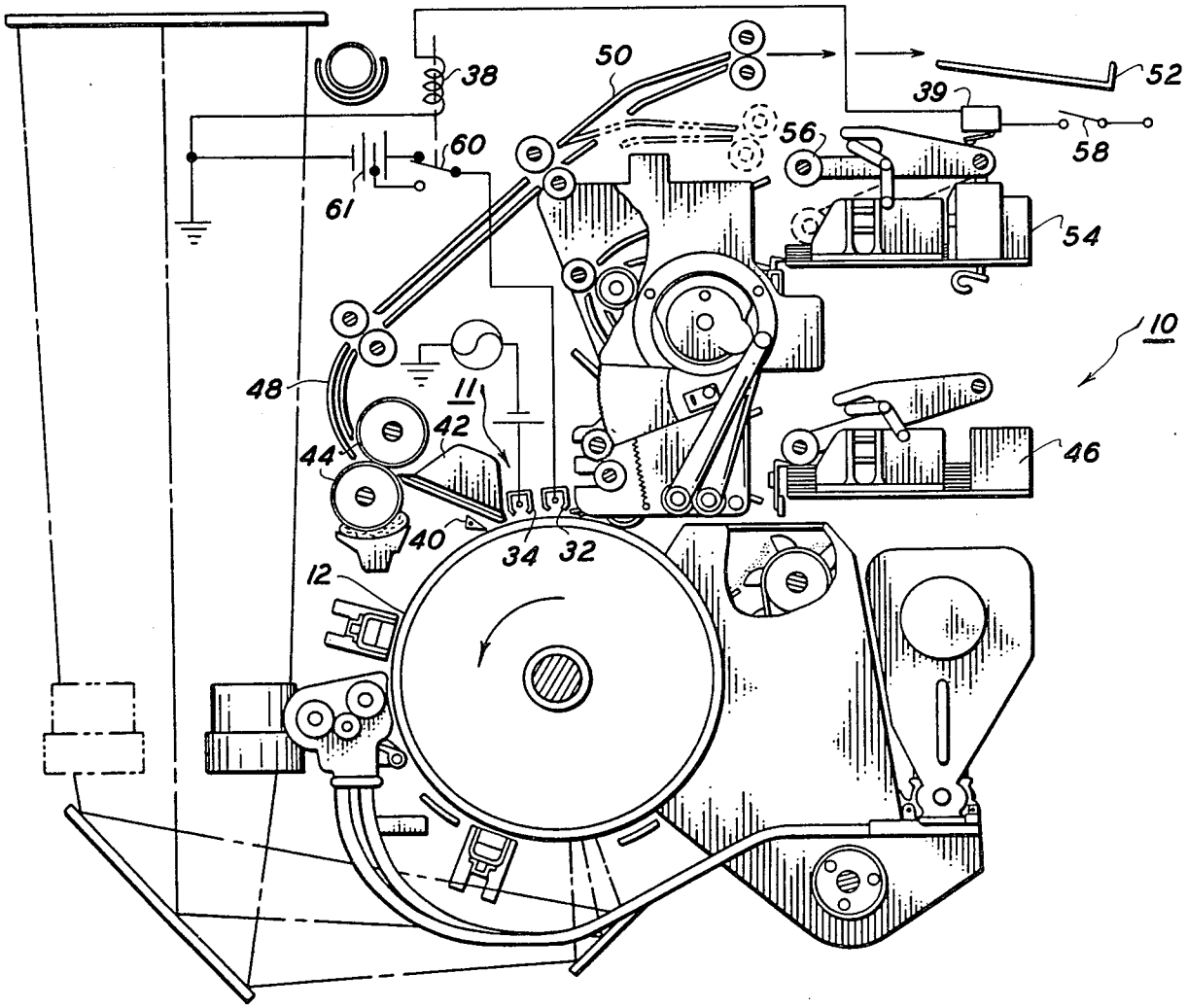

Further objects, features and advantages of the present invention pertain to the particular apparatus and details whereby the above-mentioned aspects of the invention are attained. Accordingly, the invention will be better understood by reference to the following description of examples thereof, and to the drawings forming a part of that description, wherein:

FIG. 1 is a schematic view of an exemplary electrostatographic duplex copying apparatus incorporating a transfer system in accordance with the present invention; and FIG. 2 discloses an alternative embodiment in the copying apparatus of FIG. 1.

Referring now to both Figures, there is shown an exemplary electrostatographic copying system 10 in which images are formed and developed on, and then transferred from, a photoconductive surface 12. The imaging surface 12 is acted upon (charged or discharged by) various controlled corona generating devices. The general configuration, number and type of these corona generating elements per se, and the other xerographic arrangements, may all be conventional. It will be appreciated that although individually shielded corona generators are illustrated here that it is well known that jointly or commonly shielded or unshielded corona generators may be utilized in certain situations. It is also well known that the term corona generator includes multiple wire or needle array corona generating elements as well as the single wire corona generators illustrated here. The corona generator shields here are conventionally grounded, but they may be voltage biased instead, if desired, to control the output of the corona generating elements. Likewise, the electrical power supplies are illustrated schematically since they are well known.

As shown in both Figures, which correspond generally to the Xerox Corporation "4000" copier, the developed toner image is carried on the imaging surface 12 into the transfer station 11, where it is overlaid with a copy sheet fed into registration with the toner image by conventional copy sheet feeding means. The opposite side of the copy sheet from the side in engagement with the imaging surface 12 is subjected to transfer charges by a D. C. output current transfer corona generator 32 to effect image transfer to the copy sheet of the toner particles by depositing transfer charges to the area of the copy sheet under the corona generator 32 sufficient to provide the desired transfer field. Then, to assist in stripping of the copy sheet from the imaging surface, the copy sheet is subjected, immediately downstream from the transfer corona generator 32, to an A.C. output current (D.C. biased) detacking corona generator 34.

Positive mechanical stripping of the copy sheets is provided here by the copy sheet being initially stripped from the imaging surface 12 by a stripper finger 40. The copy sheet is then slidably supported by a conductive metal vacuum shoe 42 which holds and guides the copy sheet away from the transfer station into the nip of a pair of rollers forming the image fusing station 44. U.S. Pat. No. 3,578,859, issued May 18, 1971, to W. K. Stillings describes such a copy sheet transfer, stripping and vacuum manifold system in greater detail.

The paper path in the apparatus 10 of both FiGS. 1 and 2 is the same. The copy sheets are individually fed from a copy sheet input or feed tray 46 through sheet feeding and sheet registration means into the transfer station 11, where the copy sheet is placed against the photoreceptor 12 for image transfer. Following transfer, the lead edge of the copy sheet is stripped from the photoreceptor 12 by the stripper finger 40 and captured by the vacuum manifold 42. The continued rotation of the photoreceptor drum surface 12 provides the drive for the copy sheet at this point, since that portion of the copy sheet behind the lead edge, which is still in the transfer station, is electrostatically held to the photoreceptor 12 by the transfer charges from the transfer corona generator 32. Thus, the movement of the photoreceptor 12 advances the copy sheet through the transfer station and across the vacuum manifold 42.

The vacuum manifold 42 provides a paper guide path for guiding the sheets from the transfer station 11, at the desired stripping area, into the nip of the roll fuser 44. Its apertured bottom surface extends between these two points, the width of the sheets, to secure the sheets thereto by its internal vacuum, which may be provided by a conventional blower means. It also preferably has a paper-sensing switch extending from its sheet guide surface to indicate the presence of a sheet thereon.

Significant stripping action is provided by the electrostatic stripping of the detacking corona generator 34. In fact, those sheets which have sufficient beam strength will strip from the photoreceptor solely by the beam strength of the sheet lead edge resisting conforming to the photoreceptor surface curvature, that is, these sheets will lead edge strip from the photoreceptor surface 12 without requiring stripping contact by the stripper finger 40.

In the nip of the fuser 44 the toner image just transferred to one side of the copy sheet is fused to that one side of the copy sheet. This fusing process, in which heat, and also here pressure, is applied to the copy sheet, typically causes a change in the moisture content of the copy sheet. It may also cause other characteristic changes, such as curl. The bottom roller of the fuser roller here is an internally heated fuser roll coated with a release agent such as silicone oil from a sump with a wick engaging its outer surface, as shown. This heated fuser roll engages the unfused toner bearing side of the copy sheets while the opposite side of the copy sheet is pressed thereagainst by the opposing pressure roller. Typically, the two rollers have surfaces of different materials and different pressure deformabilities, thereby forming a non-planar nip engagement therebetween.

Upon the exit of a fused copy sheet from the fuser, the copy sheet here is inverted by the paper path guides providing an approximately 90° turnaround 48. The copy sheet is then fed into a positionable output guide 50 which provides one of two selectable output paths for the copy sheet. When the output guide 50 is in the position illustrated in solid lines here the copy sheet exits directly into an output stacking tray 52. When the selectable output guide 50 is moved (by cams, solenoids, or other suitable conventional means under the control of the machine logic) into the dashed position illustrated here, the copy sheet output path is changed so as to feed all of the copy sheets into a duplex or auxiliary tray 54. This temporarily stores those first pass (simplexed) copy sheets with an image on one side thereof, which have been selected for duplex (second pass, second side) copying. The copy sheet feeder 56 for this duplex tray 54 is automatically raised out of the way to allow these copy sheets to be stacked therein. A jogging or stacking mechanism can be provided to align the sheets stacked therein as described, for example, in greater detail in U.S. Pat. No. 3,627,312, issued Dec. 14, 1971, to George E. Fackler, et al.

For automatic duplex copying, as described in the previously cited references thereon, the copy sheets are fed by the sheet feeder 56 from the duplex tray 54 back to the transfer station 11 for the (second pass) transfer of the second image to the opposite side thereof. The copy sheets are then stripped and fused in the same manner as for the first side copying. The exit path guide 50 for these duplexed copy sheets is maintained in the solid line position illustrated so as to discharge the duplexed copy sheets into the output tray 52.

The operation of the above-described duplexing system, including suitable exemplary mechanisms and circuitry for controlling the proper timed actuation of the copy sheet output path deflector 50 and the duplex tray feeder 56, may be suitable known or conventional electronic or electromechanical designs, and examples thereof are disclosed in the references previously referred to on automatic duplexing systems. This duplex control may include appropriate counting circuitry for counting up the number of copy sheets placed in the duplex tray 54 during the first pass of the duplexing run, counting down the sheets duplexed, job recovery systems, etc.. A duplex switch 58 is illustrated here to schematically represent the operator selectable duplex switch.

It will be appreciated that the present invention is not limited to automatic duplexing systems as described above. It may also be applied to manual or semi-automatic duplex copying systems in which the simplexed copies are deposited in an output tray and that stack of sheets is manually reinserted in a copy sheet input feeding tray for the second pass, where some sort of duplex selection logic signal or other indicia is available to provide a control signal to a transfer level switching system as disclosed herein in response to the selection of second side copying as distinguished from first side (first pass) copying. In such cases that, and possibly also a copy sheet count control, could be the only systems changed by actuation of the duplexing switch.

Referring now to the transfer station 11 of both Figures, as in the "4000" copier the transfer corotron 32 attracts most of the developed negative toner image to a sheet of copy paper, by placing a high positive charge on the paper (for a negative toner system), i.e., this corona generator is one having a net DC output, however generated, opposite in polarity to the toner. The charge that remains on the sheet attracts (tacks9 the paper tightly to the drum surface. The detack corotron 32 uses DC biased AC neutralization to reduce this transfer charge thereby making removal of the sheet from the photoreceptor drum surface much easier. The value of DC bias on the detack corotron is sufficient to nearly equalize the positive and negative half-cycle "on" times, thereby preventing a surplus of either a positive or negative charges remaining on the paper after detacking. This AC neutralization depends upon corotron sensitivity, charge leveling, and DC biasing. The term corotron sensitivity means that the corotron furnishes ion current in proportion to the difference between drum potential and corotron voltage. A voltage sensitive corotron, even though operated with a substantially constant supply voltage, will furnish more ion current of one polarity to a drum surface area charged to a lower voltage of the same polarity than to a drum surface area charged to a higher voltage of the same polarity, and vice versa for the opposite polarity. For a corotron to be highly sensitive it should preferably be operated at high voltage, located close to the drum surface at a uniform distance, and have a relative open-faced shield design. For proper charge leveling the alternate positive and negative cycles of an AC voltage begin and end at selected preset ionization threshold voltages. The negative half-cycle of an AC voltage supplied corotron without DC biasing normally has a lower ionization threshold, e.g., 3600 volts, than the positive half-cycle, e.g., 4500 volts. This would result in a surplus of negative ions if there were no DC level biasing of the AC supply voltage, because the negative half-cycle will be "on" (transmitting negative ions) during more of its half-cycle than the positive half-cycle. This can be altered by the DC biasing, in which a positive DC biasing voltage is combined with the AC voltage to lengthen the positive half-cycle "on" time and reduce the negative half-cycle "on" time.

Referring now to the preferred embodiment of FIG. 1, the detack corotron 34 power supply schematically shows a DC bias voltage source 35 in series with the AC supply 36 providing the desired DC biased AC output signal to the corona generating element. It may be seen that the detack corotron 34 power supply differs from the above-referenced previous detack power supplies in that the DC bias voltage supply 35 has two different output level taps **35*a* and 35*b* selectable by a switch 37. The tap 35*a* provides through the switch 37 a higher DC voltage bias than the tap 35*b* to the detack corona generator 34**, and therefore, a different net DC detacking output current from this corona generator.

The switch 37 is schematically illustrated here being controlled by a solenoid 38 connected to, and controlled by, both a duplex sheet feeding switch 39 and the duplex switch 58 noted above. The switch 39 is exemplary of a control responsive to the actual feeding of the simplexed copy sheets for their second side copying (here by the operative position of the feeder 56), while the switch 58 represents the initial selection of the duplex copying mode. The latter generally occurs prior to the first side transfer onto the sheets to be duplexed, while the switch 37 is not intended to be switched until the second side or actual duplex copying is to be initiated, i.e., not until both switches 39 and 58 are actuated here. This also accommodates the use of the auxiliary or duplex tray 54 and its feeder 56 as an alternate original copy sheet source rather than just a duplex copy sheet source, where desired, as in the 4000 copier. It will be appreciated that, particularly where the duplex tray 54 is fully dedicated to only duplex intermediate copy sheets, that the switch 39 can be eliminated or provided by other second side copying logic indicia at other machine locations.

An example of the desired switched difference in the detacking corona generator 34 output for the circuitry of FIG. 1 will be given in a "4000" copier type structure. These are conventional "base plate" measurements of the current to a 12.5 inch long conductive shoe in the position of the photoreceptor surface from the corona generator. For both simplex and duplex copying the AC supply 36 can be set to provide 92 microamperes corona output current. Operation of the switch 37 can select between a net DC output current level of +4 microamperes for simplex copying (tap 35*b*) versus +14 microamperes for duplex second pass copying (tap 35*a*). This decreases the output current of net neturalizing (negative) charges for the transfer of the second voltage. It is believed that a principle reason why such simplex/duplex reduction is attractive is its reduction in copy sheet lead edge toner disturbance stresses that occur with copy sheets having a curl up of the lead edge (a curl away from the photoreceptor surface) and a high resistivity, which is a typical condition of sheets which have been previously fused in a copying system like that disclosed.

It will be appreciated that the optimum values for the actual nominal detack current settings or power supply "tuning" to be employed will depend not only on the specific apparatus, but also on the specific copy sheet material being used and the environment in which the paper will be used. For example, copying systems being utilized almost entirely for simplex, or in higher relative humidity environments, with lower resistivity paper types, would be normally able to operate with a more negative (less positive) nominal net DC detack output current level, because high paper resistivities would be infrequent.

It should also be noted that, due to its conventional output characteristics, increasing the AC detack current level somewhat can be nearly equivalent to shifting the DC detack current in the negative direction.

It is important to note that the position at which a given area of the copy sheet actually separates (strips) from the photoreceptor surface relative to the position of the detacking corotron is significant, particularly where this stripping area occurs under the corona output area of the corotron, i.e., within the detacking charge depositing zone. This sheet stripping point will typically be later (further downstream) from the lead edge than for the body of the sheet, although lead edge outward curl can affect this. Thus, parts of the copy sheet (usually the lead edge) may be stripping after detack (beyond the detack zone) and other (subsequent) parts of the same sheet stripping during detack. The net charge left on the sheet just before separation from the photoconductor (i.e., unneutralized) will decrease in proportion to the distance the sheet moves into the detack corotron charging region increasing. Thus, for any given detacking corotron setting, the earlier a region of the paper separates from the photoconductor after entering the detack zone, the greater will be the transfer field (or paper charge) at this separation region, hence the lesser will be the chance of producing hollow characters or of having low transfer efficiency.

In the system of FIG. 1, the transfer corotron 32 is schematically illustrated with a constant voltage DC power supply 33. This corona generator 32 is preferably somewhat voltage sensitive with this arrangement, so that its transfer current output will change depending on the transfer conditions. Particularly where the conductivity of paper is sufficiently high it can cause conduction of the transfer charge along the paper, thereby reducing the peak applied transfer charge. This is particularly automatically compensated for by a corresponding increase in the output current of the voltage sensitive transfer corotron 32. Conversely, for high resistivity papers the transfer current is automatically relatively decreased.

The outputs of the transfer and detack corona generator influence one another. For example, an increase in the transfer charge remaining on the copy sheet as it passes under the detack corotron will cause an increase in the charge neutralizing output of the detack corotron, since it is preferably voltage sensitive. There may also be some direct interaction in ion flows due to the close spacing between the two corotrons.

Referring now to the alternate, but less preferred embodiment of FIG. 2, here the DC biased AC power supply for the detack corona generator 34 is not switched between simplex and duplex copying. Instead, the transfer corona supply is so switched by a switch 60 controlled similarly to the switch 37 of FIG. 1. The schematically illustrated transfer corotron power supply here is a two different voltage level output DC source 61 with the two outputs being selected between the switch 60. Operation of the duplex switching means thereby switches the transfer power supply level to lower the output current of the transfer corona generator for the second side (second image) transfer, and allowing a relatively higher transfer current for conventional one sided (simplex) or first pass (first side) duplex copying.

Considering further the theories involved, it has been observed that increasing the transfer current will cause an increase in the paper potential coming into the detack zone. However, in some cases this increased voltage will not mean an increased transfer field because there is a maximum field that can be applied. The latter is roughly 35–40 volts per micron, and is governed primarily by the size of the air gap between the paper and image. Typically, this is thought to be in the 8 to 10 micron range. When the paper voltage increases, but the transfer field does not, there can be a very large interaction between the transfer current and the detack operation. In particular, because the paper voltage in the detack zone has gone up due to the increased transfer current, the detack corotron at a given initial output current setting will supply more net negative charge to the paper when the transfer current is increased. In some cases, this increased detacking can cause a severe overneutralization of the paper, which can lead to severe transfer loss and to hollow line character defects.

A conclusion drawn is that severe transfer loss due to such overneutralization by the detack corotron should occur at high paper surface resistivities when the transfer current is increased to a desired high level, e.g., 90 microamperes or above, and the detack corotron is maintained at the conventional setting. With most copy papers, such a high paper surface resistivity (above $5\times10^{13}$ ohms) will only occur in a duplex operation (although some high resistivity papers conditioned for a long time to relative humidities in the 15% or lower range can also approach this value). Therefore, the severe transfer loss problem is mainly a duplex problem when conventional non-conditioned papers are used (or even with most conditioned papers) at conventional relative humidity levels. This enables the above-described simplex/duplex switching of the transfer current to provide the desired very high transfer current for high efficiency transfer and for prevention of toner disturbances in the simplex mode, yet also provide a lower transfer current in the duplex mode to prevent the above-noted severe transfer loss with the very high resistivity papers.

It will be appreciated that the A.C. power supplies shown schematically in the drawings may provide various appropriate waveforms and frequencies and integral D.C. biasing. An appropriate detack corona generator power supply is an approximately 400 Hertz square wave generator in which the waveform symmetry relative to machine ground is adjusted to adjust the D.C. bias level.

In conclusion, there has been disclosed herein an improved electrostatic transfer control system. Numerous advantages and applications, in addition to those described above, will be apparent to those skilled in the art. While the embodiments generally disclosed herein are generally considered to be preferred, numerous variations and modifications will be apparent to those skilled in the art. The following claims are intended to cover all such variations and modifications as fall within the true spirit and scope of the invention.

What is claimed is:

1. In an electrostatic copying apparatus in which a first image of fusable material formed on an initial image support surface is transferred by electrostatic field producing transfer means applying transfer charges to a first side of a copy sheet, and said first image of fusable material is then thermally fused to said copy sheet by fusing means acting thereon, and in which a second image formed on said initial image support surface is transferred to the second, opposite, side of said same copy sheet by said transfer means subsequent to said fusing of said first image to said first side, wherein said transfer means includes detacking corona generator means for applying an alternating current output with a net direct current output of neutralizing charges to said copy sheet to at least partially neutralize said transfer charges, and wherein said net direct current output of said detacking corona generator means has a nominal output current level for said transfer of said first image to said first side of said copy sheet, the improvement comprising duplex switching means for automatically changing said nominal output current level of said detacking corona generator for said transfer of said second image to said second side of said copy sheet to compensate for changes in the transfer characteristics of said copy sheet due to said first image being fused to said first side thereof, wherein said duplex switching means automatically decreases said net direct current neutralizing charge output from said detacking corona generator for said transfer of said second image to said second side of said copy sheet relative to said nominal output current level.

* * * * *